US010123147B2

(12) United States Patent
Shih et al.

(10) Patent No.: US 10,123,147 B2
(45) Date of Patent: Nov. 6, 2018

(54) ENHANCED AUDIO EFFECT REALIZATION FOR VIRTUAL REALITY

(71) Applicant: MediaTek Inc., Hsinchu (TW)

(72) Inventors: Xin-Wei Shih, Changhua County (TW); Yiou-Wen Cheng, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 15/408,538

(22) Filed: Jan. 18, 2017

(65) Prior Publication Data

US 2017/0195816 A1 Jul. 6, 2017

Related U.S. Application Data

(60) Provisional application No. 62/287,479, filed on Jan. 27, 2016.

(51) Int. Cl.
*H04R 5/02* (2006.01)
*H04S 7/00* (2006.01)

(52) U.S. Cl.
CPC ..... *H04S 7/303* (2013.01); *H04S 7/307* (2013.01); *H04S 2400/11* (2013.01)

(58) Field of Classification Search
None
See application file for complete search history.

(56) References Cited

U.S. PATENT DOCUMENTS

2010/0034404 A1* 2/2010 Dent ..... H04R 5/02 381/310
2013/0236040 A1* 9/2013 Crawford ..... H04S 7/304 381/310
2016/0227338 A1* 8/2016 Oh ..... H04S 7/303

* cited by examiner

*Primary Examiner* — James Mooney
(74) *Attorney, Agent, or Firm* — Han IP PLLC; Andy M. Han

(57) ABSTRACT

Methods and apparatuses pertaining to enhanced audio effect realization for virtual reality may involve receiving data in a virtual reality setting. The data may be related to audio samples from one or more sound sources, motions of the one or more sound sources, and motions of a user. Physics simulation may be performed for realization of one or more audio effects based on the received data. Signal processing may be performed using a result of the physics simulation. Audio outputs may be provided using a result of the signal processing.

20 Claims, 15 Drawing Sheets

ENHANCED AUDIO EFFECT REALIZATION FOR VIRTUAL REALITY

CROSS REFERENCE TO RELATED PATENT APPLICATION(S)

The present disclosure is part of a non-provisional application claiming the priority benefit of U.S. Patent Application No. 62/287,479, filed on 27 Jan. 2016, which is incorporated by reference in its entirety.

TECHNICAL FIELD

The present disclosure is generally related to virtual reality and, more particularly, to enhanced audio effect realization for virtual reality.

BACKGROUND

Unless otherwise indicated herein, approaches described in this section are not prior art to the claims listed below and are not admitted to be prior art by inclusion in this section.

Other than a realistic visual experience, a realistic hearing experience from a user perspective is also a key factor for a user to have an immersive experience in virtual reality (VR). In general, sounds in VR can be generated by limited channels such as the two headphones worn by the user. In practice, the hearing experience tends to be different from the sounds in real world which usually come in all directions within a given environment. For example, in a VR application in which a source of music is to the north of the user, channel outputs would be different when the user faces west and when the user faces east. Moreover, typically a user would not fix his/her head is a given position for a prolonged period of time; rather, it is likely that the user would constantly move his/her head, and this would require changes in channel outputs over time according to the head motion of the user. Accordingly, the ability to render audio effects through limited channels to match or otherwise mimic a real-world hearing experience is a goal of audio-related technologies in the context of VR.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to propose a novel scheme that enables enhanced audio effect realization for VR. In one aspect, a method in accordance with the present disclosure may involve receiving data in a virtual reality setting, with the data related to audio samples from one or more sound sources, motions of the one or more sound sources, and motions of a user. The method may also involve performing physics simulation for realization of one or more audio effects based on the received data. The method may further involve performing signal processing using a result of the physics simulation. The method may additionally involve generating audio outputs using a result of the signal processing.

In another aspect, an apparatus in accordance with the present disclosure may include a processor. The processor may include a simulation circuit and a signal processing circuit coupled to the simulation circuit. The simulation circuit may be capable of receiving data in a virtual reality setting, the data related to audio samples from one or more sound sources, motions of the one or more sound sources, and motions of a user. The simulation circuit may also be capable of performing physics simulation for realization of one or more audio effects based on the received data. The signal processing circuit may be capable of performing signal processing using a result of the physics simulation. The signal processing circuit may also be capable of generating audio outputs using a result of the signal processing. Alternatively, the aforementioned operations, functions and/or actions performed by the simulation circuit and/or signal processing circuit may be implemented by software executed by the processor.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Figure 1:
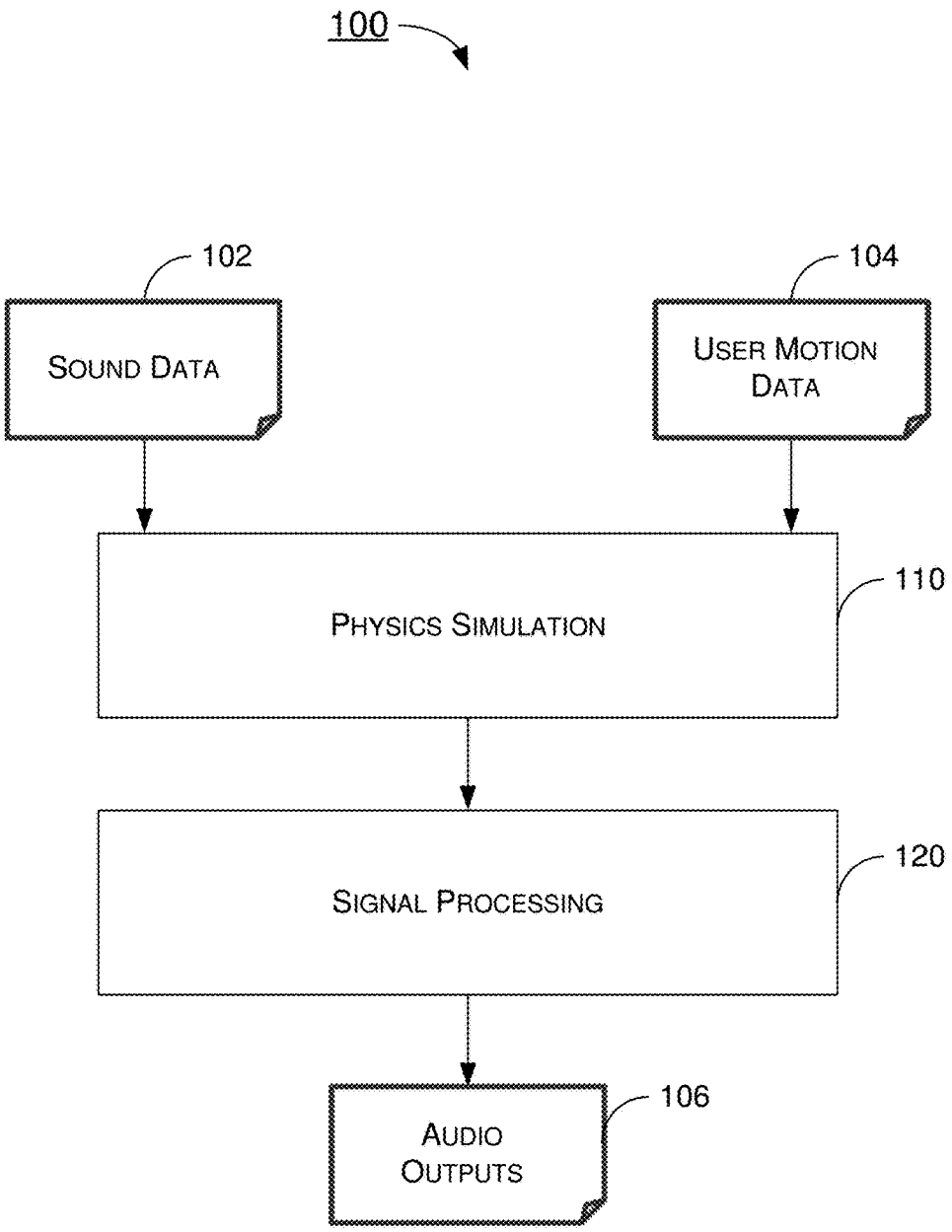
FIG. 1 is a diagram depicting a concept of the proposed scheme of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

A key to achieving realistic hearing experience from a user perspective is simulation of various audio effects including, for example and without limitation, direction, reverberation, attenuation, occlusion, transmission time, and Doppler effect. The audio effect of "direction" refers to the ability to distinguish different sound sources at different directions with respect to the user. The audio effect of "reverberation" refers to the collection of reflected sounds in a closed space. The audio effect of "attenuation" refers to energy loss as sound is transmitted through one or more media. The audio effect of "occlusion" refers to changes in a sound signal when a transmission path of the sound is blocked or otherwise obstructed by one or more objects, e.g., wall. The audio effect of "transmission time" refers to the time for transmission of sound (represented by sound waves or acoustic waves) through a given medium. The audio effect of "Doppler effect" refers to an observed frequency shift, which happens when a relative velocity or motion exists between an observer and a sound source.

In VR applications, the Doppler effect is an audio effect that tends to be difficult to be rendered. Doppler effect can be expressed by the equation of $f=[(c+v_r)/(c+v_s)]*f_0$. Here, $f_0$ denotes the frequency of the sound from a sound source, c denotes the velocity of sound in a given medium, $v_r$ denotes a velocity of an observer, $v_s$ denotes a velocity of the sound source, and f denotes the resultant or otherwise shifted frequency due to Doppler effect. Based on this equation, there are two types of frequency change (herein interchangeably referred as "frequency shift"), namely: upshift and downshift. Frequency upshift occurs when a distance between the observer and the sound source is decreasing (e.g., they are getting closer), and consequently the frequency of the sound received or heard by the observer is shifted up. Frequency downshift occurs when a distance between the observer and the sound source is increasing (e.g., they are getting farther apart), and consequently the frequency of the sound received or heard by the observer is shifted down.

Although some of the aforementioned audio effects can be rendered by applying filters, the frequency change with respect to Doppler effect in VR tends to be difficult to be rendered by simply applying filters since the sound source(s) and the observer (e.g., a user of a VR application) may be in motion constantly. For instance, with pure signal processing to realize Doppler effect under conventional approaches, the pure signal processing cannot determine which type of frequency shift should be applied. Moreover, the pure signal processing cannot know the degree of frequency shift. Accordingly, the proposed scheme in accordance with the present disclosure provides techniques, methods and apparatuses that realize Doppler effect in real-time for VR applications.

FIG. 1 illustrates a concept 100 of the proposed scheme of the present disclosure. Concept 100 may involve one or more operations, actions and/or functions as represented by one or more blocks such as blocks 110 and 120 shown in FIG. 1. Although illustrated as discrete blocks, various blocks of concept 100 may be divided into additional blocks, combined into fewer blocks, or eliminated, depending on the desired implementation. Concept 100 may be implemented by a control logic, one or more processors, and/or an electronic apparatus, each of which implementable in hardware operable with appropriate firmware, software and/or middleware. For illustrative purposes and without limitation, the following description of concept 100 is provided in the context of a processor (e.g., a digital signal processor (DSP), an application processor (AP), or the like) implementable in an electronic apparatus (e.g., a smartphone, a tablet or a laptop computer).

At 110, concept 100 may involve the processor performing physics simulation for realization of one or more audio effects based on sound data 102 and user motion data 104. Sound data 102 may include, for example, audio data of sound from one or more sound sources as well as motion data on the motion of each of the one or more sound sources. User motion data 104 may include, for example, motion data on the motion of a head of a user (e.g., represented by motion of a VR headgear worn by the user). In the context of Doppler effect, a result of the physics simulation may include a type of frequency shift and a degree of shift with respect to the sound from each of the one or more sound sources. Concept 100 may proceed from 110 to 120.

At 120, concept 100 may involve the processor, using the result of the physics simulation (e.g., the type of frequency shift and degree of shift for Doppler effect), performing signal processing to generate audio outputs 106, which may be outputs of sound(s) to speakers of a left headphone and a right headphone of a VR headgear worn by the user. For instance, concept 100 may involve the processor performing resampling, sample rendering and sample mixing with respect to signal processing. In the context of Doppler effect, the signal processing under concept 100 may involve revising, adjusting or otherwise modifying audio samples by resampling, depending on the type of frequency shift and the degree of shift.

Figure 2:
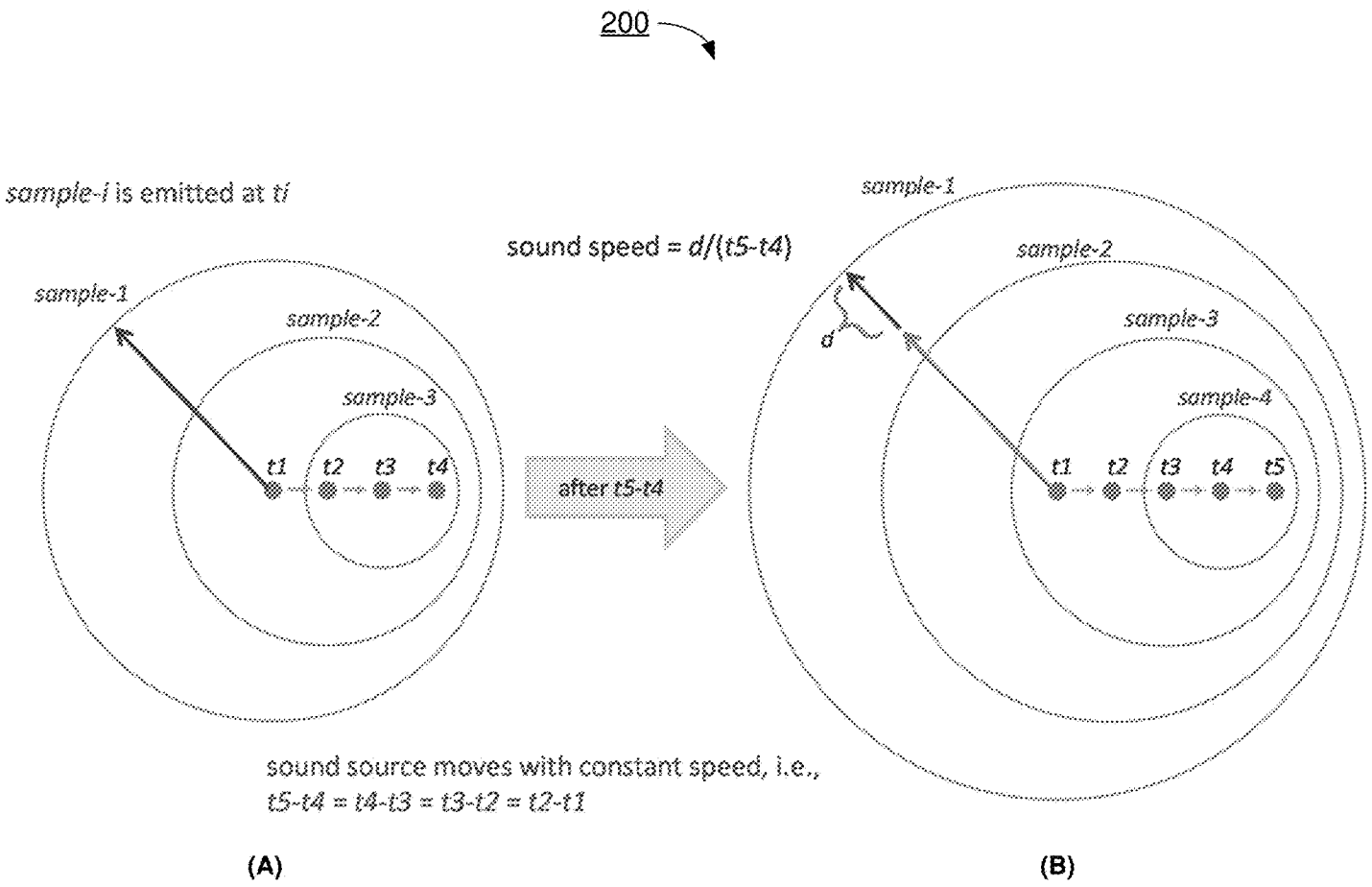
FIG. 2 is a diagram of an example scenario in accordance with an implementation of the present disclosure.

FIG. 2 illustrates an example scenario 200 in accordance with an implementation of the present disclosure. Scenario 200 represents a scenario of physics simulation and resampling with respect to simulation of the physics of Doppler effect. To simulate the physics, audio samples may be spread from each sound source, and such process is referred as sample spreading. The spreading origin is the position at which the sound source emits a sample. The spreading speed equals to the speed of sound. The spreading positions for an audio sample form a wavefront, which indicates the maximum range that the audio sample can be heard by the user.

In scenario 200, the sound source moves at a constant speed, and a respective audio sample is emitted by the sound source at each of times t1, t2, t3, t4 and t5. Accordingly, a time interval between t5 and t4, a time interval between t4 and t3, a time interval between t3 and t2, and a time interval between t2 and t1 are equal. The speed of sound can be represented by the equation of speed of sound=d/(t5−t4), where d denotes a distance or amount of spread between two samples. Part (A) of scenario 200 shows three wavefronts, represented by sample-1, sample-2 and sample-3, having been generated and spread at time t4. Part (B) of scenario 200 shows four wavefronts, represented by sample-1, sample-2, sample-3 and sample-4, having been generated and spread at time t5.

Figure 3:
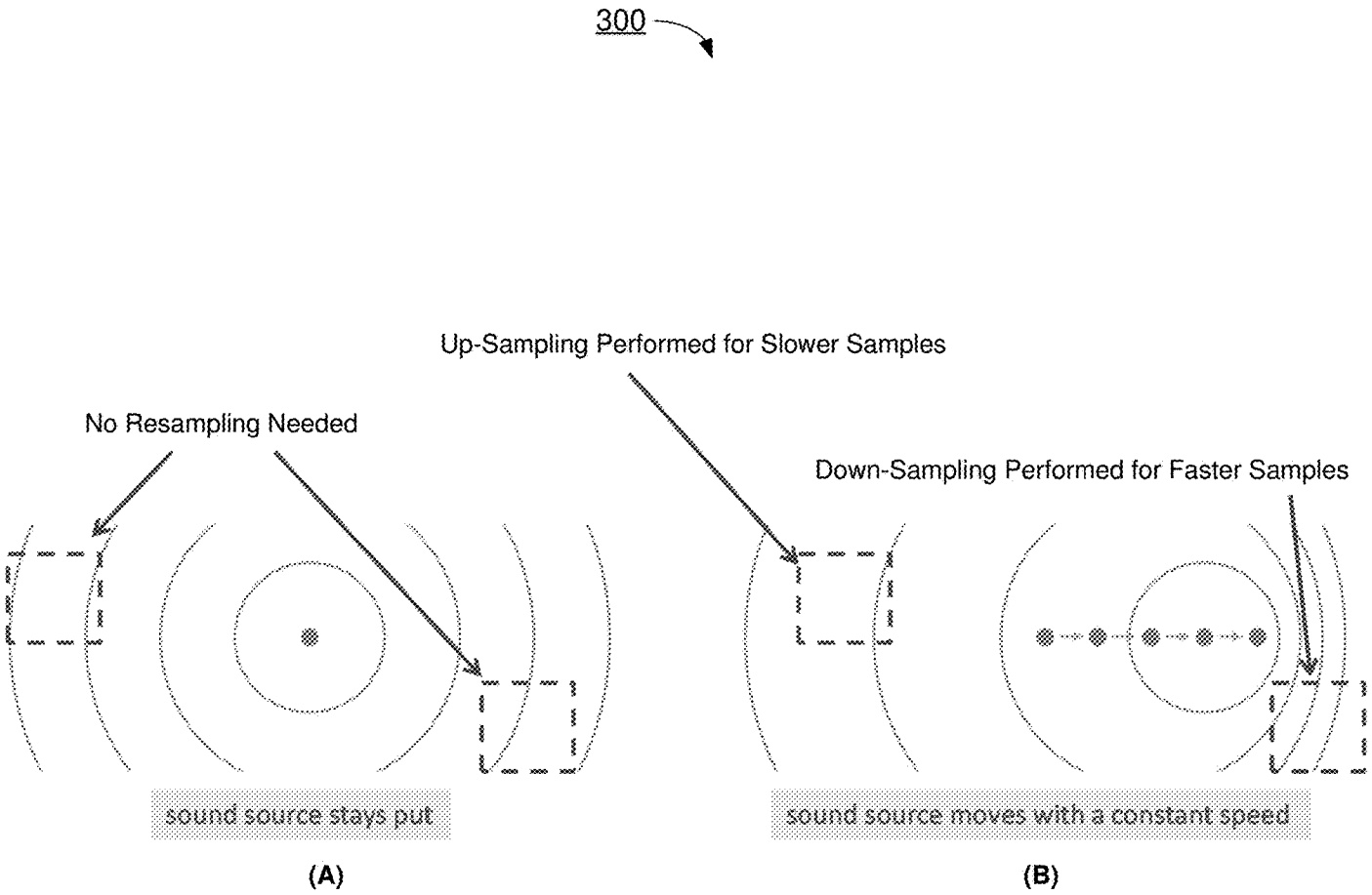
FIG. 3 is a diagram of an example scenario in accordance with an implementation of the present disclosure.

FIG. 3 illustrates an example scenario 300 in accordance with an implementation of the present disclosure. Scenario 300 represents a scenario of resampling with respect to Doppler effect. In resampling, the motion of each sound source, the sample spreading wavefronts and the motion of the user in the virtual reality setting are tracked in order to determine the type of frequency shift (e.g., upshift or downshift). Then, the audio data, or audio samples, are resampled based on the determined type of frequency shift.

In part (A) of scenario 300, the sound source stays put or otherwise is stationary. Accordingly, there is no need of resampling since the audio samples do not arrive faster or slower than the sampling rate. In part (B) of scenario 300, the sound source moves at a constant speed. In an event that the sound source is moving away from the observer, the audio samples would arrive slower than the sampling rate of the original sound. Accordingly, frequency downshift may be achieved by up-sampling to maintain the sampling rate. In an event that the sound source is moving closer to the observer, the audio samples would arrive faster than the sampling rate of the original sound. Accordingly, frequency upshift may be achieved by down-sampling to maintain the sampling rate.

Figure 4:
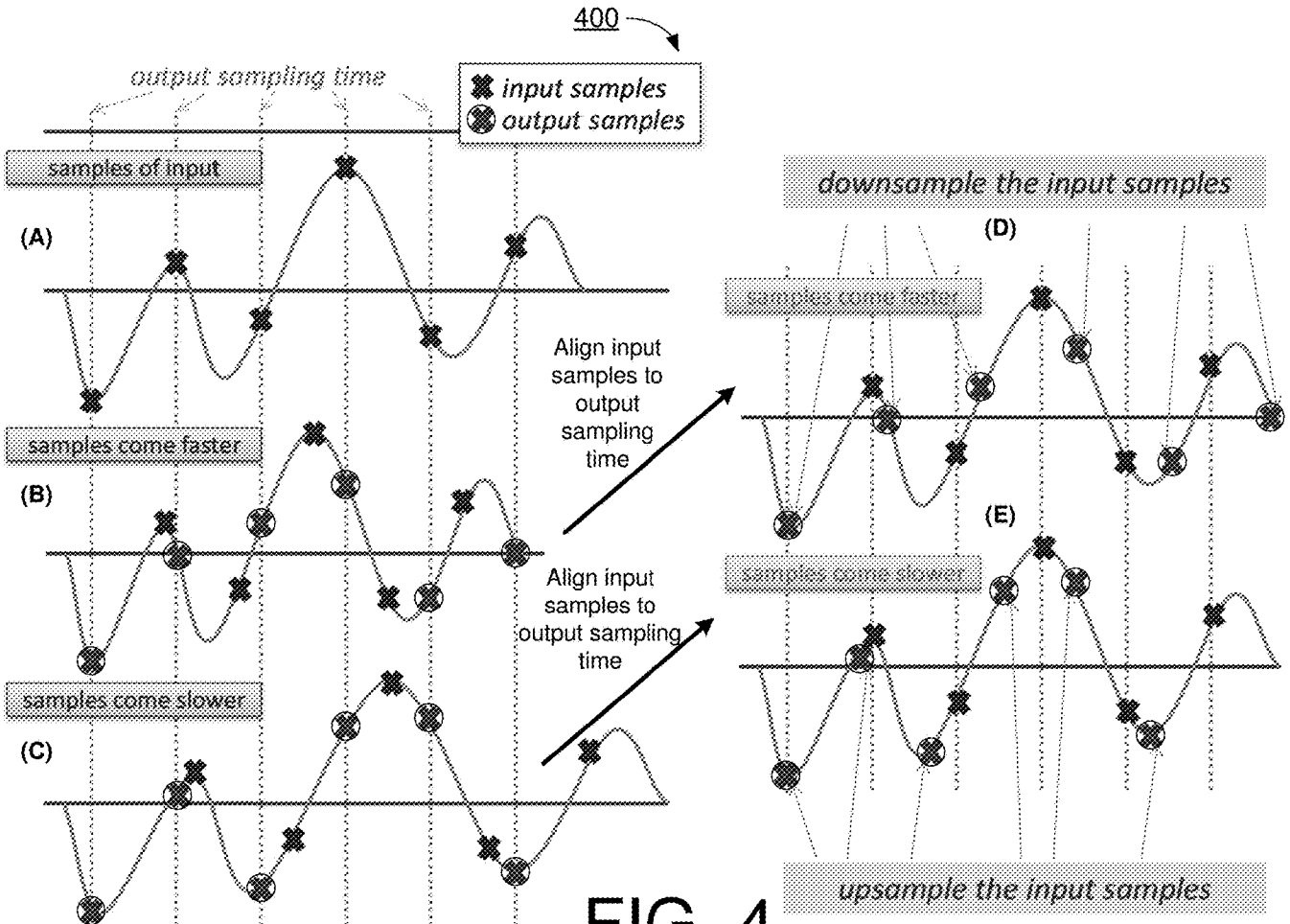
FIG. 4 is a diagram of an example scenario in accordance with an implementation of the present disclosure.

FIG. 4 illustrates an example scenario 400 in accordance with an implementation of the present disclosure. Scenario 400 represents a scenario of down-sampling and up-sampling with respect to Doppler effect. Part (A) of scenario 400 shows a series of input audio samples. Part (B) of scenario 400 shows output samples vis-a-vis the input audio samples in an event that the input audio samples arrive faster (e.g., when the sound source is moving closer to the observer). Part (C) of scenario 400 shows output samples vis-a-vis the input audio samples in an event that the input audio samples arrive slower (e.g., when the sound source is moving away from the observer). Part (D) of scenario 400 shows down-sampling of the input audio samples in an event that the input audio samples arrive faster to realize output samples in part (B). Part (E) of scenario 400 shows up-sampling of the input audio samples in an event that the input audio samples arrive slower to realize output samples in part (C).

Figure 5:
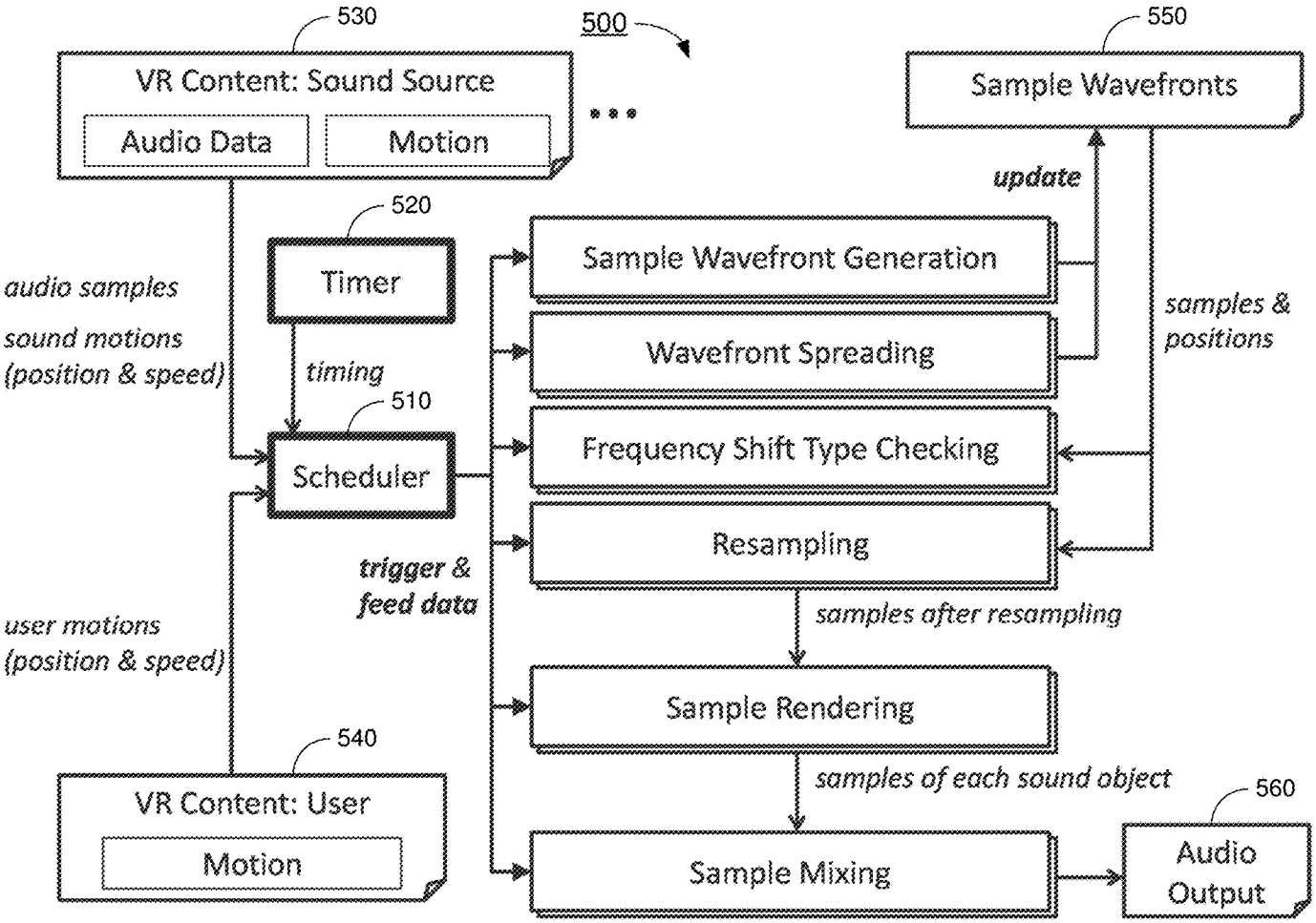
FIG. 5 is a diagram of an example scheme in accordance with an implementation of the present disclosure.
Figure 6:
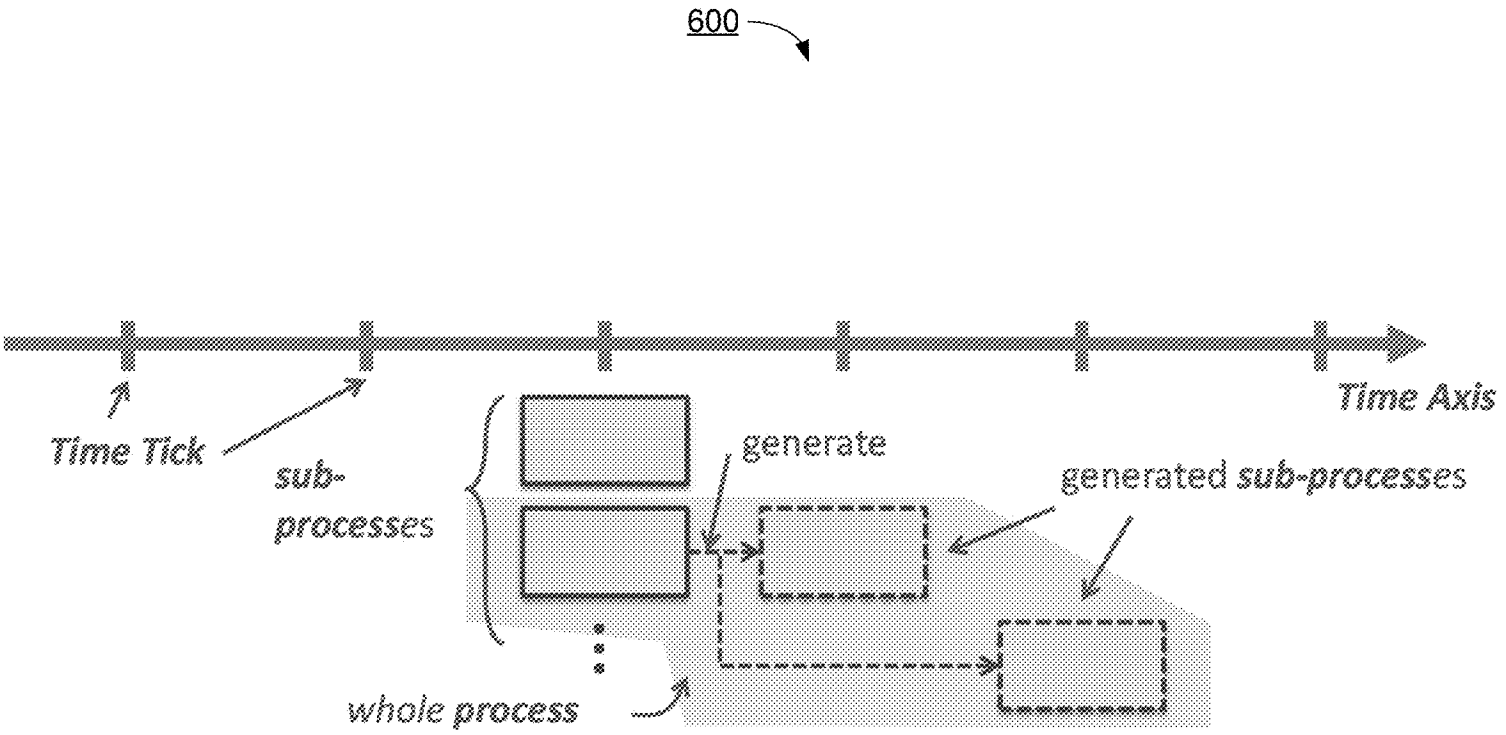
FIG. 6 is a diagram of an example scenario in accordance with an implementation of the present disclosure.
Figure 7:
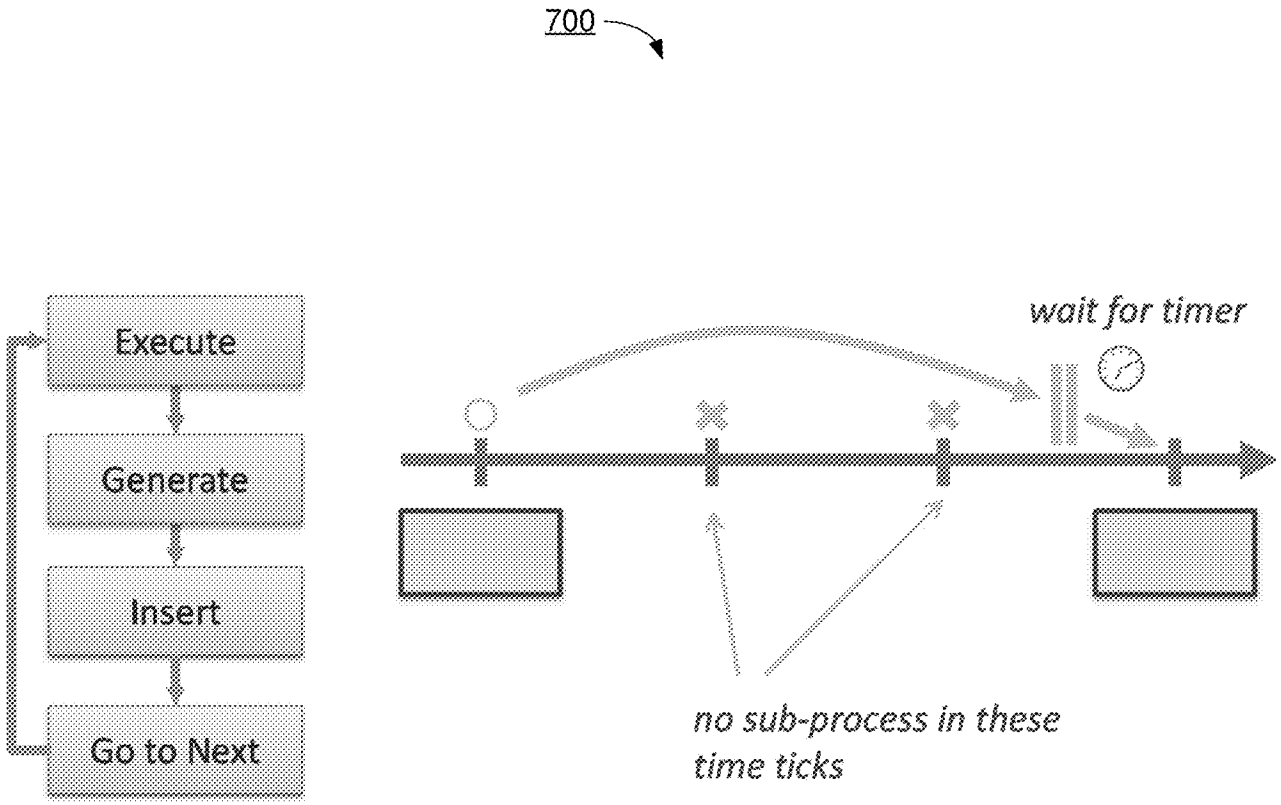
FIG. 7 is a diagram of an example scenario in accordance with an implementation of the present disclosure.
Figure 8:
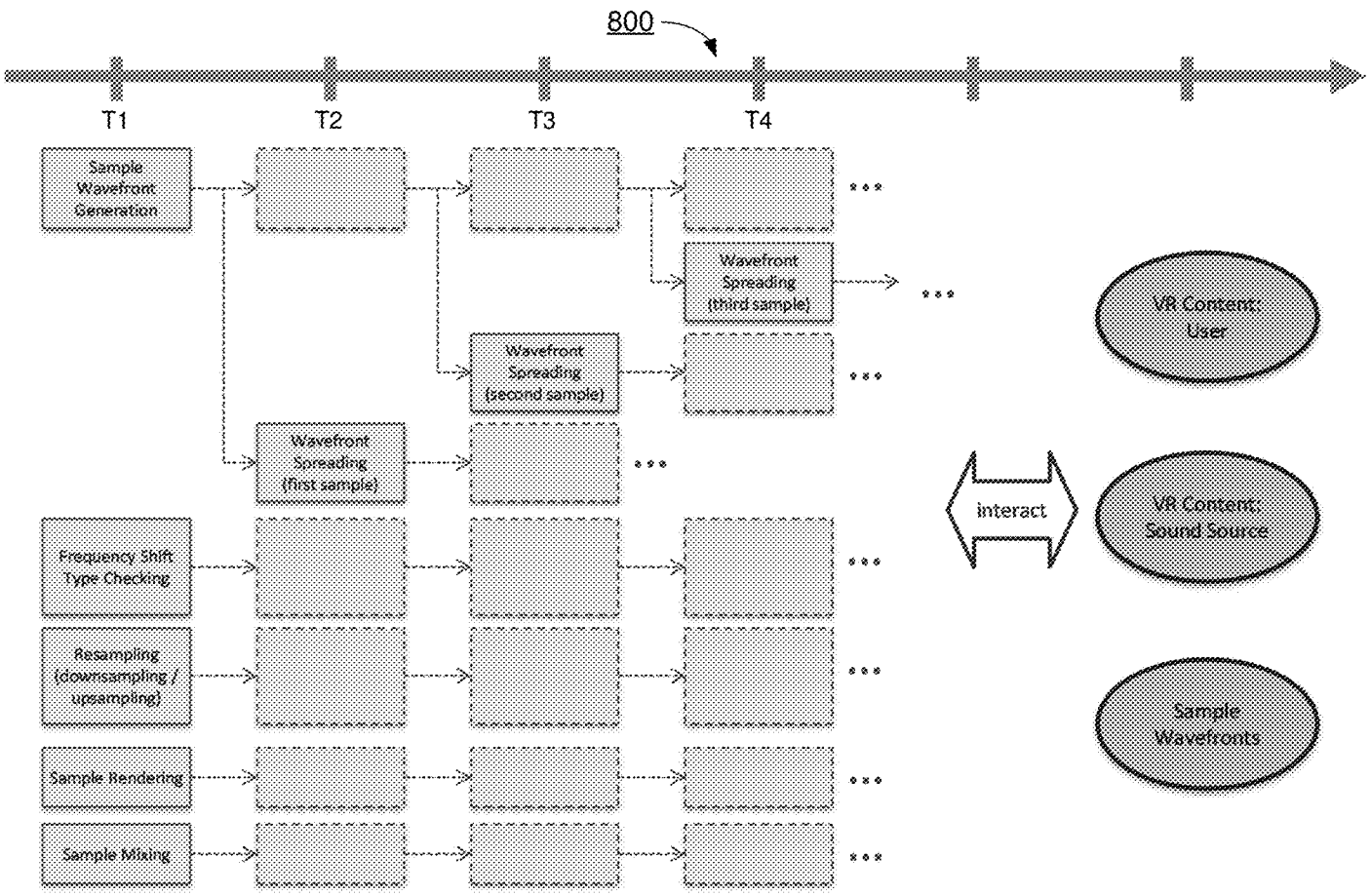
FIG. 8 is a diagram of an example scenario in accordance with an implementation of the present disclosure.
Figure 9:
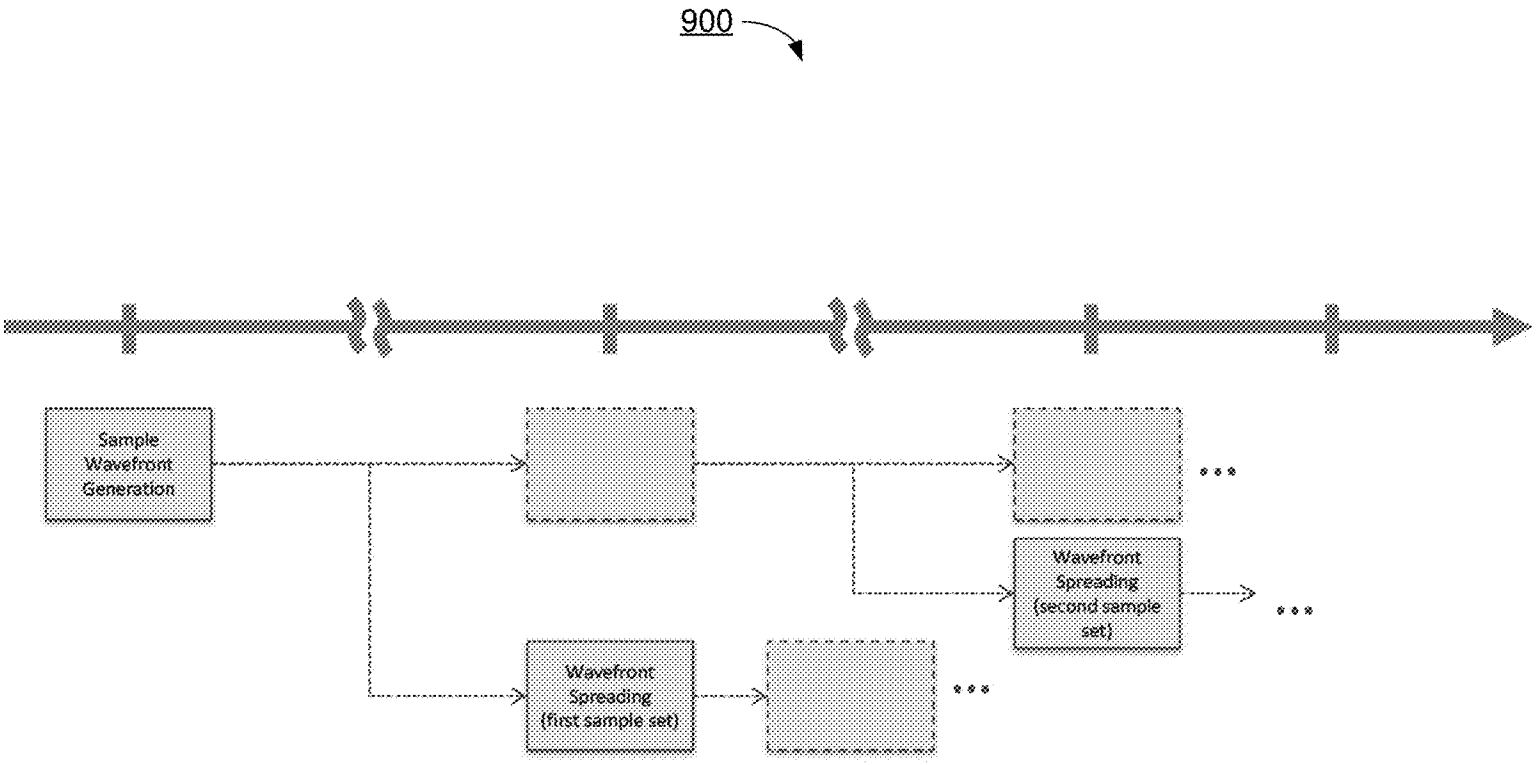
FIG. 9 is a diagram of an example scenario in accordance with an implementation of the present disclosure.
Figure 10:
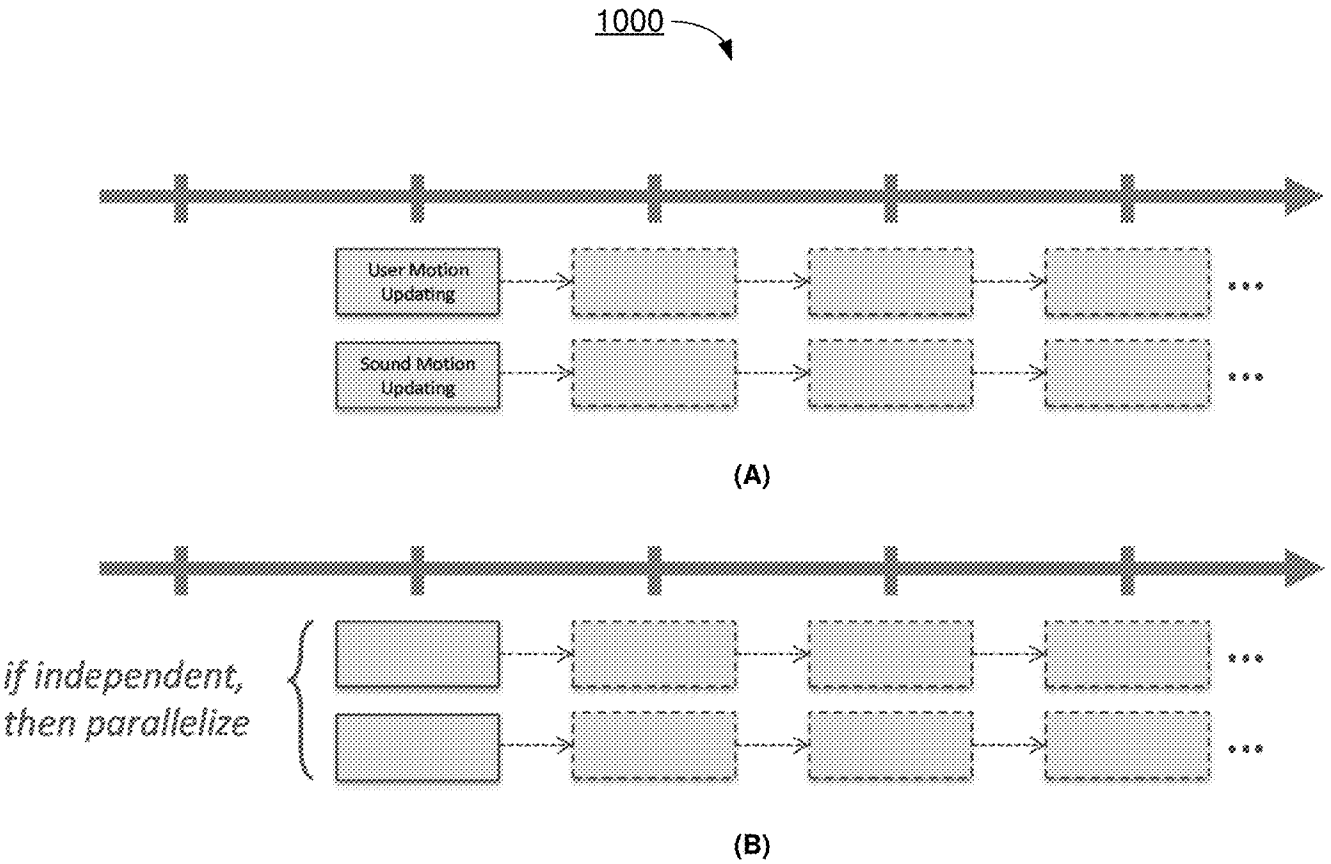
FIG. 10 is a diagram of an example scenario in accordance with an implementation of the present disclosure.

FIG. 5 illustrates an example scheme 500 in accordance with an implementation of concept 100. Each of FIG. 6-FIG. 10 illustrates a respective example scenario in accordance with an implementation of scheme 500. Accordingly, scheme 500 is described below with reference to FIG. 6-FIG. 10.

Under scheme 500, a number of tasks may be executed or otherwise carried out for the realization of one or more audio effects. In the example shown in FIG. 5, in the context of simulating Doppler effect as physics simulation in 110 of concept 100, scheme 500 may involve executing the following tasks to complete the realization of Doppler effect: (1) sample wavefront generation, (2) wavefront spreading, (3) determination of type of frequency shift, (4) resampling, (5) sample rendering, and (6) sample mixing. In scheme 500, a scheduler 510 may be utilized to determine appropriate timing for execution of each task and to trigger the execution thereof. In scheme 500, a timer 520 may also be utilized to provide time information to scheduler 510. When triggering the execution of the tasks, scheduler 510 may provide, as input for the tasks, data 530 of VR content of one or more sound sources as well as data 540 of VR content of the user. For instance, in implementing concept 100 in scheme 500, data 530 of VR content of one or more sound sources may be sound data 102 shown in FIG. 1. Similarly, in implementing concept 100 in scheme 500, data 540 of VR content of the user may be user motion data 104 shown in FIG. 1. Data 530 may include, for example and without limitation, audio samples and sound motions (e.g., position and speed) with respect to each of the one or more sound sources. Data 540 may include, for example and without limitation, user motions (e.g., position and speed) of the user. Execution of the tasks may result in the generation of sample wavefronts 550 and audio outputs 560. In some implementations, either or both of scheduler 510 and timer 520 may be implemented in the form of software. Alternatively, either or both of scheduler 510 and timer 520 may be implemented in the form of hardware.

In some implementations, scheduler 510 may be realized by a concept of time axis in accordance with the present disclosure, and the time axis may be utilized to simulate behaviors changing over time. Under the concept of time axis, the execution of a number of tasks may be considered as a process, and the time for execution of a process may be divided into a number of small time pieces or time segments. Instead of a direct execution of an entire process, execution of a given process may be done by dividing the process into a number of sub-processes, and execution of each sub-process may be triggered at a corresponding time segment. Each sub-process may correspond to a respective task. With respect to the tasks for the realization of Doppler effect, each task may be seen or considered as a process for scheduler 510. Moreover, the behavior of each sub-process may be adjusted during its corresponding time segment. For example, behaviors of sub-processes may be adjusted in response to motions of a user and/or motions of one or more sound sources in a VR setting. In view of the above, scheduler 510 is key in scheme 500 for achieving real-time audio rendering for VR applications.

The concept of time axis may be explained in detail with reference to scenarios 600, 700, 800, 900 and 1000 as shown in FIG. 6-FIG. 10, respectively. In scenario 600, time ticks may utilized along a time axis to indicate time units (e.g., the aforementioned time segments). Each time tick may correspond to the execution of one or more sub-processes. In some implementations, each sub-process may be implemented by a respective code set, and thus execution of a given sub-process may involve execution of the respective code set. After execution of a given sub-process, one or more sub-processes may be generated to be inserted back into the time axis at some future time tick(s). In some implementations, a set of sub-processes and generated sub-processes may form a complete process. Additionally, the way of sub-process generation may define the behavior of the entire process. It is noteworthy that there is no restriction on the interval between time ticks. For example and without limitation, the interval may be 1 second, 1 millisecond, or ¼8 milliseconds. The exact value of the interval may depend on the implementation requirement.

Scenario 700 illustrates a working relation between timer 520 and an execution flow of scheduler 510. In scenario 700, for each time tick, scheduler 510 may execute the one or more sub-processes corresponding to the time tick in concern and, optionally, generate one or more sub-processes for future execution. Scheduler 510 may also insert the generated sub-processes into target time tick(s) in the future along the time axis. Then, scheduler 510 may proceed to the next time tick by waiting until such time arrives according to time information provided by timer 520. For example, scheduler 510 would wait without execution for those time ticks having no sub-process for execution.

Scenario 800 illustrates the execution of tasks as sub-processes. In the example shown in FIG. 8, for a given time tick on the time axis, a number of sub-processes (or tasks) may be executed for the realization of Doppler effect, including: sample wavefront generation, determination or checking of the type of frequency shift, resampling (either down-sampling or up-sampling), sample rendering, and sample mixing. After the execution of the sub-process of sample wavefront generation, a sub-process of wavefront spreading may be generated and inserted into a subsequent time tick. This may be done for a number of samples. It is noteworthy that, during the execution of the sub-processes, scheduler 510 may continue to provide new data 530 and new data 540 regarding updated VR content of the one or more sound sources as well as VR content of the user. Additionally, new sample wavefronts 550 may be generated.

In some implementations, a higher resolution (e.g., shorter interval between every two adjacent time ticks) may be utilized for the time axis. For example, for audio outputs at 48 kHz, the interval between every two adjacent time ticks may be ¼8 milliseconds in order to meet the sampling rate.

Under scheme 500, for each sound source, the task of sample wavefront generation may generate a wavefront for an audio sample at each time tick (e.g., at time ticks T1, T2, T3, T4 and so on in scenario 800). That is, each wavefront may be mapped to a particular audio sample in the audio data of data 530 for VR content of the one or more sound sources. For each generated wavefront, the task of wavefront spreading may expand the wavefront positions based on the speed of sound (e.g., at time ticks T2, T3, T4 and so on in scenario 800). Moreover, scheme 500 may cease maintaining a given wavefront when the spreading radius of that wavefront exceeds an audible range at which the sound can be heard by the user in the VR setting. It is noteworthy that, during the simulation of wavefront spreading, the transmission time of sound (as sound waves or acoustic waves) may also be simulated simultaneously. Thus, description pertaining to the simulation of wavefront spreading herein may also be applied to the simulation of the transmission time of sound. Thus, in the interest of brevity, such description is not repeated so as to avoid redundancy.

Under scheme 500, the task of determination (or checking) of the type of frequency shift may observe the wavefronts near the user to determine whether the type is upshift or downshift, and this task may be performed at each time tick (e.g., at time ticks T1, T2, T3, T4 and so on in scenario 800). For example, when multiple wavefronts hit the user, the type of frequency shift may be determined as upshift. As another example, when no wavefront hits the user and there exists wavefronts in the audible range of the user, the type of frequency shift may be determined to be downshift.

Under scheme 500, the task of resampling may resample the audio samples to meet the output sampling rate, and this task may be performed at each time tick (e.g., at time ticks T1, T2, T3, T4 and so on in scenario 800). For example, down-sampling may be performed based on the hit wavefronts to generate samples with higher frequency. Conversely, up-sampling may be performed based on the wavefronts in the audible range of the user to generate samples with lower frequency. It is noteworthy that there is no fixed resulting number of samples for resampling since motions of the one or more sound sources and motions of the user may be constantly changing over time.

Under scheme 500, the task of sample rendering may perform filtering on the resampled samples for one or more audio effects to result in final samples for each sound source, and this task may be performed at each time tick (e.g., at time ticks T1, T2, T3, T4 and so on in scenario 800). The one or more audio effects may include, for example and without limitation, direction, reverberation, attenuation, occlusion, and Doppler effect.

Under scheme 500, the task of sample mixing may mix the final samples from all sound sources to generate audio outputs 560, and this task may be performed at each time tick (e.g., at time ticks T1, T2, T3, T4 and so on in scenario 800). In some implementations, audio outputs 560 may represent at least left and right tracks or speakers of headphones in the VR headgear worn by the user.

Scenario 900 illustrates an alternative utilization of time axis in accordance with the present disclosure. In scenario 900, the task of sample wavefront generation may generate one wavefront for a set of audio samples instead of one audio sample. That is, each wavefront may represent a set of audio samples. Accordingly, the task of resampling may be performed based on sets of audio samples.

In some implementations, a lower resolution (e.g., longer interval between every two adjacent time ticks) may be utilized for the time axis. For example, for audio outputs at 48 kHz, the interval between every two adjacent time ticks may be 1 millisecond in order to meet the sampling rate. To user a lower resolution, each sub-process may manipulate a set of audio samples instead of a single audio sample at a time.

Scenario 1000 illustrates additional features under scheme 500 in accordance with the present disclosure.

Part (A) of scenario 1000 shows additional tasks under scheme 500. For example, a task of user motion update may involve a number of sub-processes at every time tick to extract information on the motion of the user, including head direction sensed by a headset worn by the user as well as user position in the VR setting. Additionally, a task of sound motion update may involve a number of sub-processes at every time tick to simulate moving behaviors of sound(s) such as, for example and without limitation, a straight line path with constant speed or a circular path with varying speed.

Part (B) of scenario 1000 shows that independent sub-processes as well as independent processes under the same time tick may be executed in parallel. For example, the computing power of multiple cores of a multi-core processor may be utilized to execute multiple sub-processes/processes in parallel.

Figure 11:
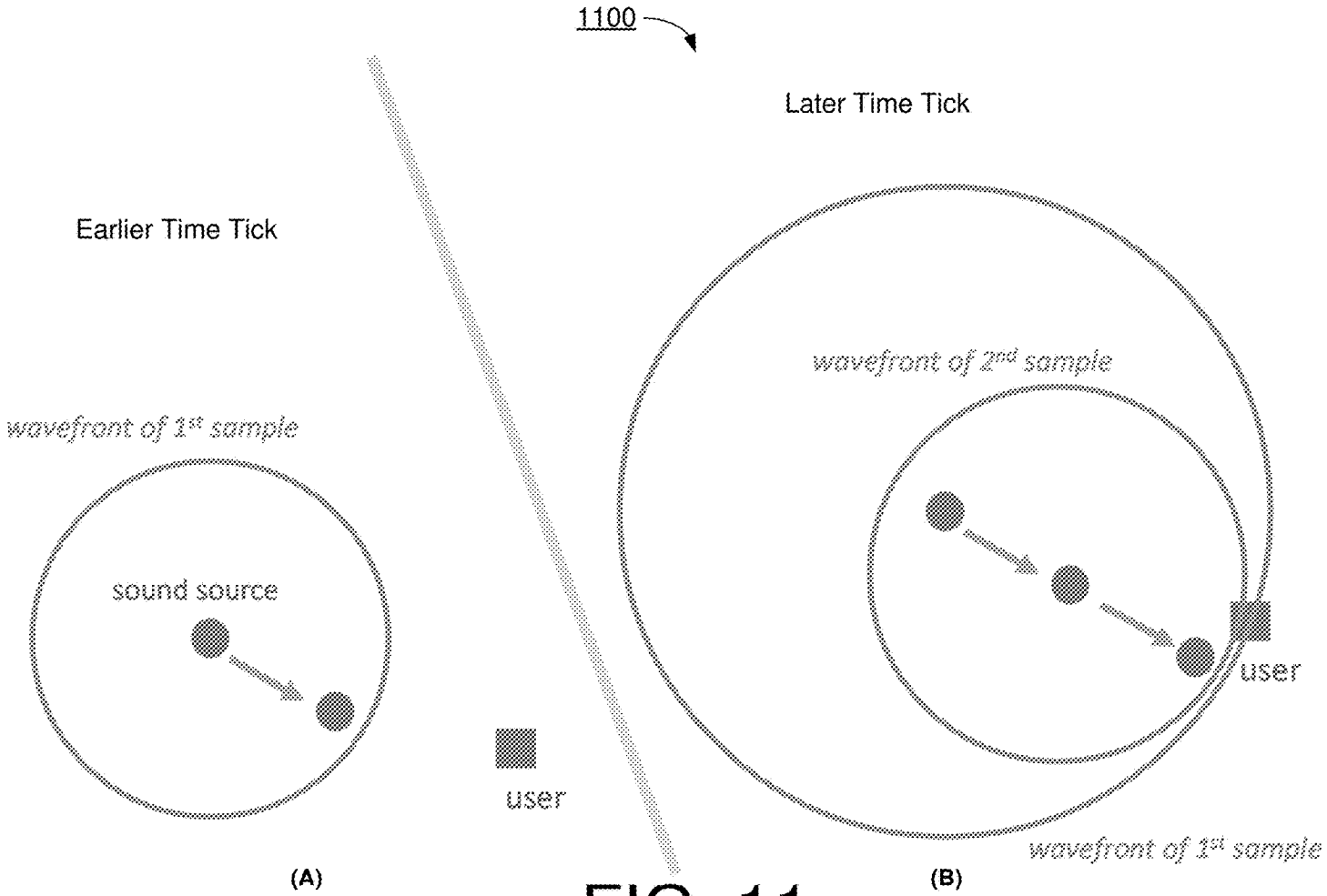
FIG. 11 is a diagram of an example scenario in accordance with an implementation of the present disclosure.

FIG. 11 illustrates an example scenario 1100 in accordance with an implementation of the present disclosure. Scenario 1100 represents a scenario of an upshift in frequency under scheme 500. Part (A) of scenario 1100 corresponds to an earlier time tick while part (B) of scenario 1100 corresponds to a later time tick. In part (A) of scenario 1100, scheme 500 may involve generating wavefronts and maintaining the locus of the wavefronts. Scheme 500 may also involve spreading each wavefront based on the speed of sound. In part (B) of scenario 1100, wavefronts of a first audio sample and a second audio sample may hit the user in the VR setting. Thus, scheme 500 may involve performing down-sampling based on the two samples to output one correct sample for Doppler effect.

Figure 12:
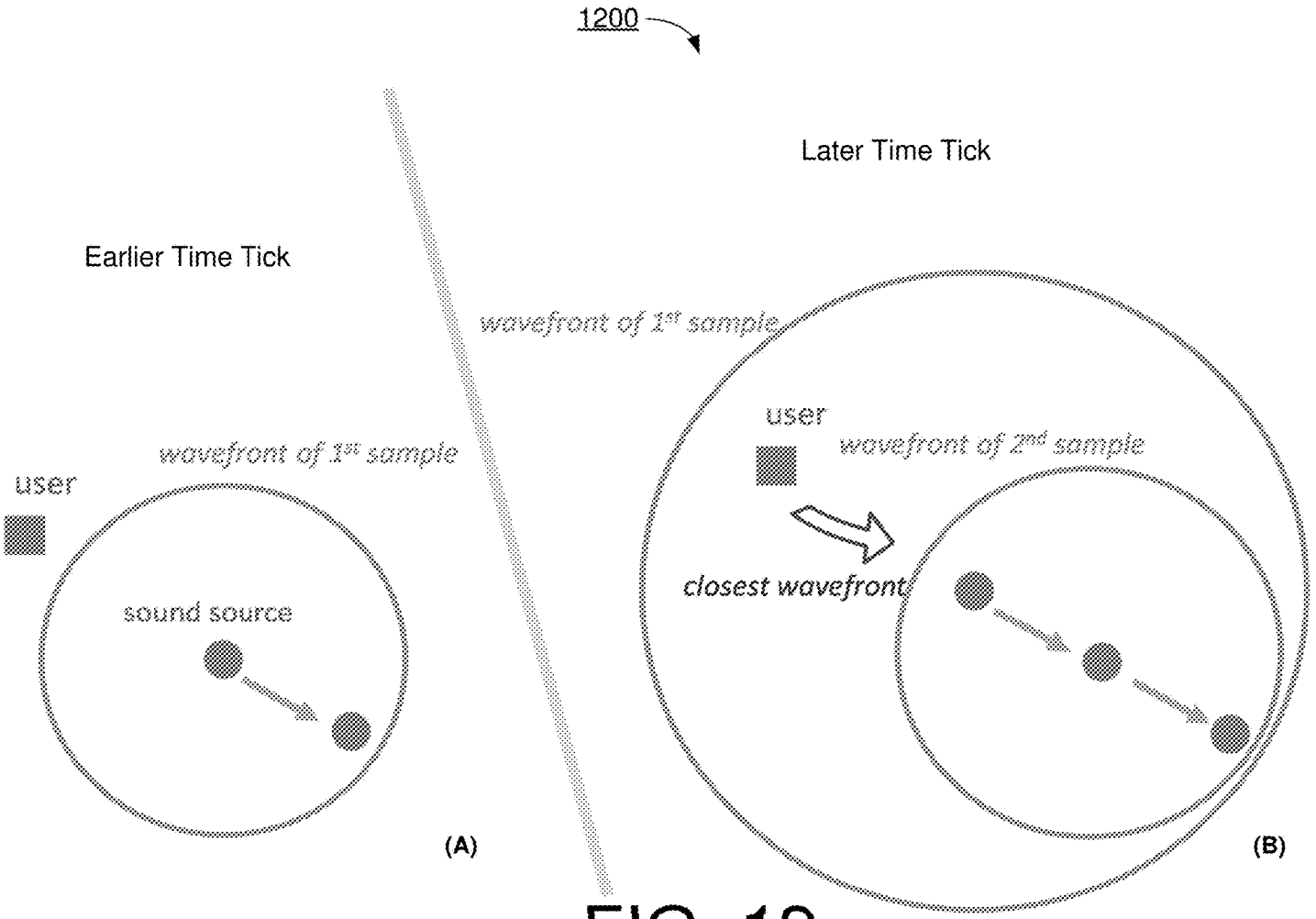
FIG. 12 is a diagram of an example scenario in accordance with an implementation of the present disclosure.

FIG. 12 illustrates an example scenario 1200 in accordance with an implementation of the present disclosure. Scenario 1200 represents a scenario of a downshift in frequency under scheme 500. Part (A) of scenario 1200 corresponds to an earlier time tick while part (B) of scenario 1200 corresponds to a later time tick. In part (A) of scenario 1200, scheme 500 may involve generating wavefronts and maintaining the locus of the wavefronts. Scheme 500 may also involve spreading each wavefront based on the speed of sound. In part (B) of scenario 1200, after the wavefront of a first audio sample hits the user, the wavefront of a second audio sample may not hit the user because the sound source may be moving away from the user. In order to output the next sample, scheme 500 may involve finding wavefront(s) in the audible range of the user (e.g., the closest wavefront), and performing up-sampling based on the audio sample(s) of previous wavefront(s) having hit the user and the closest wavefront.

Illustrative Implementations

Figure 13:
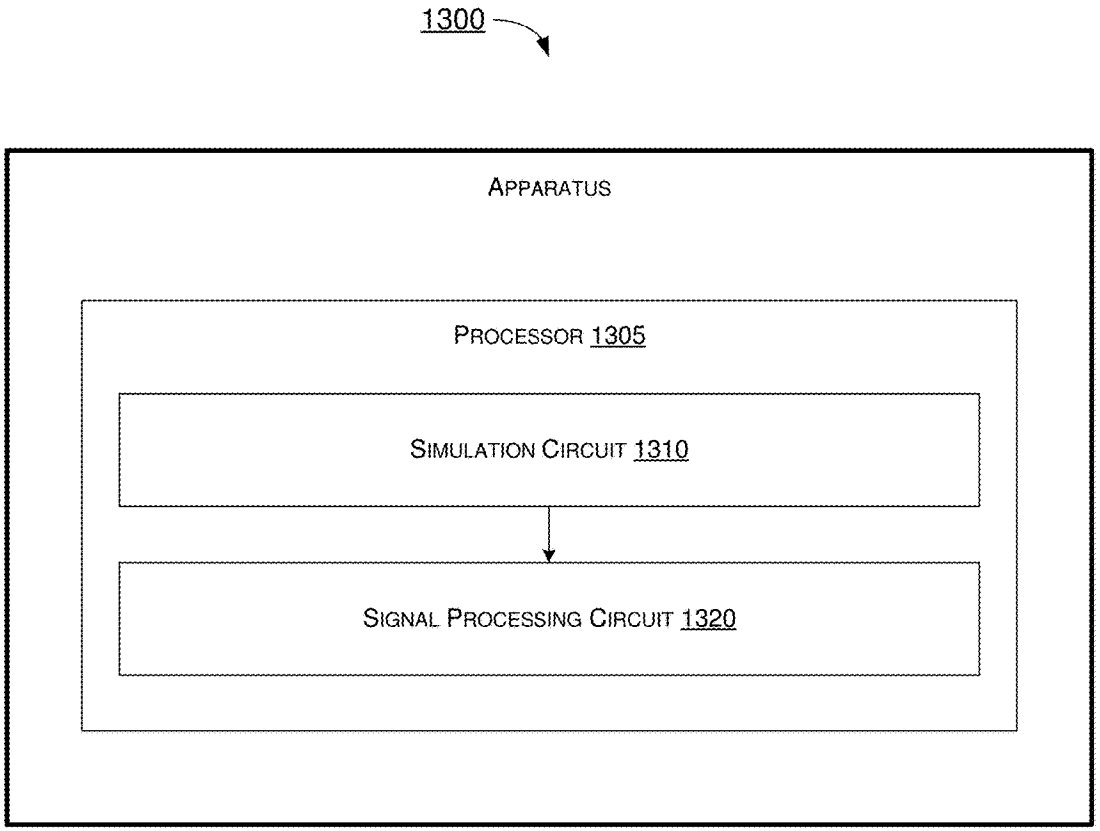
FIG. 13 is a block diagram of an example apparatus in accordance with an implementation of the present disclosure.

FIG. 13 illustrates an example apparatus 1300 in accordance with an implementation of the present disclosure. Apparatus 1300 may perform various functions to implement schemes, techniques, processes and methods described herein pertaining to enhanced audio effect realization for virtual reality, including concept 100, scheme 500 and scenarios 200, 300, 400, 600, 700, 800, 900, 1000, 1100 and 1200 described above as well as process 1500 described below. Apparatus 1300 may be a part of an electronic apparatus, which may be a portable or mobile apparatus, a wearable apparatus, a wireless communication apparatus or a computing apparatus. For instance, apparatus 1300 may be implemented in a smartphone, a smartwatch, a personal digital assistant, a digital camera, or a computing equipment such as a tablet computer, a laptop computer, a notebook computer, a desktop computer, or a server. Alternatively, apparatus 1300 may be implemented in the form of one or more integrated-circuit (IC) chips such as, for example and without limitation, one or more single-core processors, one or more multi-core processors, or one or more complex-instruction-set-computing (CISC) processors. Apparatus 1300 may include at least those components shown in FIG. 13, such as a processor 1305. Apparatus 1300 may further include one or more other components not pertinent to the proposed scheme of the present disclosure (e.g., internal power supply, communication device, display device and/or user interface device), and, thus, such component(s) are neither shown in FIG. 13 nor described below in the interest of simplicity and brevity. For instance, in some implementations, apparatus 1300 may be a VR-related apparatus and may also include components such as a head-mounted device, headphones (or earphones) and one or more sensors (e.g., accelerometer(s), gyroscope(s), image sensor(s), infrared sensor(s), ultrasound sensor(s), and the like). In the interest of brevity, as apparatus 1300 may be implemented in various applications, such additional components are neither shown nor described herein.

In one aspect, processor 1305 may be implemented in the form of one or more single-core processors, one or more multi-core processors, or one or more CISC processors. That is, even though a singular term "a processor" is used herein to refer to processor 1305, processor 1305 may include multiple processors in some implementations and a single processor in other implementations in accordance with the present disclosure. In another aspect, processor 1305 may be implemented in the form of hardware (and, optionally, firmware) with electronic components including, for example and without limitation, one or more transistors, one or more diodes, one or more capacitors, one or more resistors, one or more inductors, one or more memristors and/or one or more varactors that are configured and arranged to achieve specific purposes in accordance with the present disclosure. In other words, in at least some implementations, processor 1305 is a special-purpose machine specifically designed, arranged and configured to perform specific tasks including enhanced audio effect realization for virtual reality in accordance with various implementations of the present disclosure.

Processor 1305 may include a simulation circuit 1310 and a signal processing circuit 1320 coupled to simulation circuit 1310. Simulation circuit 1310 may be capable of receiving data in a virtual reality setting. The data may be related to audio samples from one or more sound sources, motions of the one or more sound sources, and motions of a user. Simulation circuit 1310 may be capable of performing physics simulation for realization of one or more audio effects based on the received data. Signal processing circuit 1320 may be capable of performing signal processing using a result of the physics simulation. Signal processing circuit 1320 may also be capable of generating audio outputs using a result of the signal processing.

In some implementations, in performing the physics simulation for the realization of the one or more audio effects, simulation circuit 1310 may be capable of performing a number of operations. For instance, simulation circuit 1310 may generate sample wavefronts for the audio samples. Additionally, simulation circuit 1310 may spread the sample wavefronts. Moreover, simulation circuit 1310 may determine a type of frequency shift and a degree of shift for each of the audio samples based on a respective one of the sample wavefronts observed near the user in the virtual reality setting.

In some implementations, in performing the signal processing, signal processing circuit 1320 may be capable of performing a number of operations. For instance, for each sound source of the one or more sound sources, signal processing circuit 1320 may resample each of the audio sample according to the respective type of frequency shift and the respective degree of shift to provide resampled audio samples. Also, for each sound source of the one or more sound sources, signal processing circuit 1320 may perform sample rendering on the resampled audio samples by filtering for the one or more audio effects to provide final samples. Furthermore, signal processing circuit 1320 may mix the final samples from the one or more sound sources to generate the audio outputs.

In some implementations, each of the sample wavefronts may represent a respective set of samples of the audio samples. In such cases, in resampling each of the audio samples, signal processing circuit 1320 may be capable of resampling a plurality sets of samples of the audio samples.

In some implementations, in performing the physics simulation for the realization of the one or more audio effects, simulation circuit 1310 may be capable of simulating physics pertaining to a Doppler effect experienced by the user in the virtual reality setting to obtain information on a type of frequency shift and a degree of shift for each of the audio samples. In some implementations, in performing the signal processing, signal processing circuit 1320 may be capable of revising the audio samples by resampling the audio samples depending on the respective type of frequency shift and the respective degree of shift for each of the audio samples.

In some implementations, in performing the physics simulation for the realization of the one or more audio effects, simulation circuit 1310 may be capable of simulating changes of one or more behaviors of the one or more sound sources and one or more behaviors of the user over time along a time axis.

In some implementations, in simulating the changes of the one or more behaviors of the one or more sound sources and the one or more behaviors of the user over time along the time axis, simulation circuit 1310 may be capable of executing a plurality of tasks to realize a Doppler effect experienced by the user in the virtual reality setting. For instance, simulation circuit 1310 may generate sample wavefronts for the audio samples. Additionally, simulation circuit 1310 may spread the sample wavefronts. Moreover, simulation circuit 1310 may determine a type of frequency shift and a degree of shift for each of the audio samples based on a respective one of the sample wavefronts observed near the user in the virtual reality setting. Furthermore, simulation circuit 1310 may simulate a transmission time of sound with respect to the audio samples from the one or more sound sources. For each sound source of the one or more sound sources, signal processing circuit 1320 may resample each of the audio sample according to the respective type of frequency shift and the respective degree of shift to provide resampled audio samples. Moreover, for each sound source of the one or more sound sources, signal processing circuit 1320 may perform sample rendering on the resampled audio samples by filtering for the one or more audio effects to provide final samples. Furthermore, signal processing circuit 1320 may mix the final samples from the one or more sound sources to generate the audio outputs. In some implementations, a scheduler (e.g., scheduler 510) may be utilized to determine, based on time information from a timer (e.g., timer 520), timing for execution of each of the tasks and triggers the execution.

In some implementations, in executing the plurality of tasks to realize the Doppler effect experienced by the user in the virtual reality setting, simulation circuit 1310 may be capable of performing a number of operations. For instance, simulation circuit 1310 may divide a process for each of the tasks into a respective plurality of sub-processes such that each sub-process corresponds to a respective time segment of a plurality of time segments along the time axis. Additionally, simulation circuit 1310 may adjust each of the sub-processes according to motions of the one or more sound sources and motions of the user during the corresponding time segment.

In some implementations, in simulating the changes of the one or more behaviors of the one or more sound sources and the one or more behaviors of the user over time along the time axis, simulation circuit 1310 may be capable of executing a plurality of tasks to realize a Doppler effect experienced by the user in the virtual reality setting by performing a number of operations. For instance, simulation circuit 1310 may divide a process for each of the tasks into a respective plurality of sub-processes such that each sub-process corresponds to a respective time segment of a plurality of time segments along the time axis. During each time segment, simulation circuit 1310 may perform operations including: executing the corresponding sub-process; determining whether a next sub-process for one or more target time segments later in time along the time axis is to be generated; generating the next sub-process responsive to a positive result of the determining; inserting the next sub-process into the one or more target time segments; executing the next sub-process upon arrival of the one or more target time segments; updating a motion of the user based on the data related to the motions of the user for the time segment; and updating a respective motion of each of the one or more sound sources based on the data related to the motions of the one or more sound sources for the time segment. In some implementations, the updating of the motion of the user and the updating of the respective motion of each of the one or more sound sources may be performed in parallel.

Figure 14:
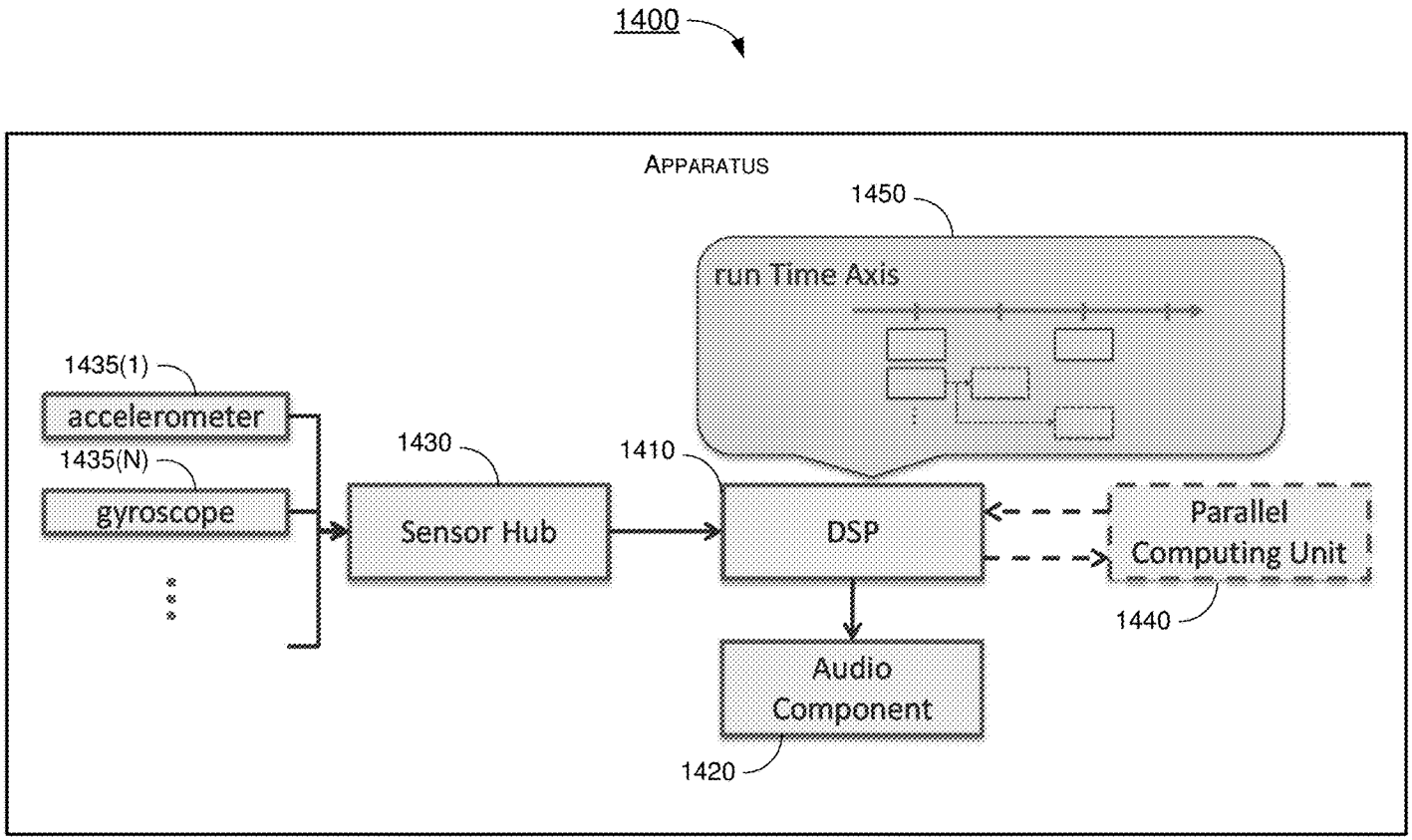
FIG. 14 is a block diagram of an example apparatus in accordance with an implementation of the present disclosure.

FIG. 14 illustrates an example apparatus 1400 in accordance with an implementation of the present disclosure. Apparatus 1400 may perform various functions to implement schemes, techniques, processes and methods described herein pertaining to enhanced audio effect realization for virtual reality, including concept 100, scheme 500 and scenarios 200, 300, 400, 600, 700, 800, 900, 1000, 1100 and 1200 described above as well as process 1500 described below. Apparatus 1400 may be a part of an electronic apparatus, which may be a portable or mobile apparatus, a wearable apparatus, a wireless communication apparatus or a computing apparatus. For instance, apparatus 1400 may be implemented in a smartphone, a smartwatch, a personal digital assistant, a digital camera, or a computing equipment such as a tablet computer, a laptop computer, a notebook computer, a desktop computer, or a server. Apparatus 1400 may further include one or more other components not pertinent to the proposed scheme of the present disclosure (e.g., internal power supply, communication device, display device and/or user interface device), and, thus, such component(s) are neither shown in FIG. 14 nor described below in the interest of simplicity and brevity. For instance, in some implementations, apparatus 1400 may be a VR-related apparatus and may also include components such as a head-mounted device, headphones (or earphones) and one or more sensors (e.g., accelerometer(s), gyroscope(s), image sensor(s), infrared sensor(s), ultrasound sensor(s), and the like). In the interest of brevity, as apparatus 1400 may be implemented in various applications, such additional components are neither shown nor described herein.

Apparatus 1400 may include one, some or all of those components shown in FIG. 14, such as a processor 1410 (e.g., a digital signal processor (DSP) or an application processor (AP)). Apparatus 1400 may further include one or more other components not pertinent to the proposed scheme of the present disclosure (e.g., internal power supply, communication device, display device and/or user interface device), and, thus, such component(s) are neither shown in FIG. 14 nor described below in the interest of simplicity and brevity. Processor 1410 (labeled as "DSP" in FIG. 14, although processor 1410 may be a different type of processor in various implementations) may be an example implementation of processor 1305. Accordingly, features, functions and description pertaining to processor 1305 and its components are applicable to processor 1410 and are not repeated herein to avoid redundancy. Processor 1410 may perform operations or otherwise execute processes, sub-processes and/or tasks by utilizing a time axis 1450 as described above in scenarios 600-1000.

In some implementations, apparatus 1400 may also include an audio component 1420, which may represent a collection of output audio samples from processor 1410. Although shown as being separate from processor 1410, in some implementations, audio component 1420, as data, may be stored in processor 1410. In some other implementations, audio component 1420, as data, may be stored in a memory or storage device (not shown). Moreover, in some implementations, each component of apparatus 1400 shown in FIG. 14 may be implemented as hardware. That is, audio component 1420 may represent earphone(s), headphone(s) and/or speaker(s) for VR, and in such cases audio data may be conveyed from one component to another in FIG. 14 in the direction shown by the arrows. For instance, audio data may be transmitted, conveyed or otherwise outputted from processor 1410 (e.g., as DSP or AP) to audio component 1420 for output by audio component 1420 (e.g., as earphone (s), headphone(s) and/or speaker(s) for VR). Additionally or alternatively, apparatus 1400 may include a sensor hub 1430 and a number of sensors 1435(1)-1435(N). For example, sensors 1435(1)-1435(N) may include one or more accelerometers and/or one or more gyroscopes to sense motions of a user (e.g., motions of the head of the user) as represented by motions of a headgear worn by the user. Sensor hub 1430 may collect data from sensors 1435(1)-1435(N) and provide to processor 1410 the collected data as data on motions of the user. Advantageously, the use of low-level units such as sensor hub 1430 for sensor data and DSP as processor 1410 for achieving the proposed scheme (scheme 500) may reduce a latency typically associated with communications between high-level and low-level computing units. In some implementations, apparatus 1400 may also include one or more parallel computing units 1440 (e.g., one or more cores of multi-core processor(s)) to execute processes/sub-processes in parallel.

Figure 15:
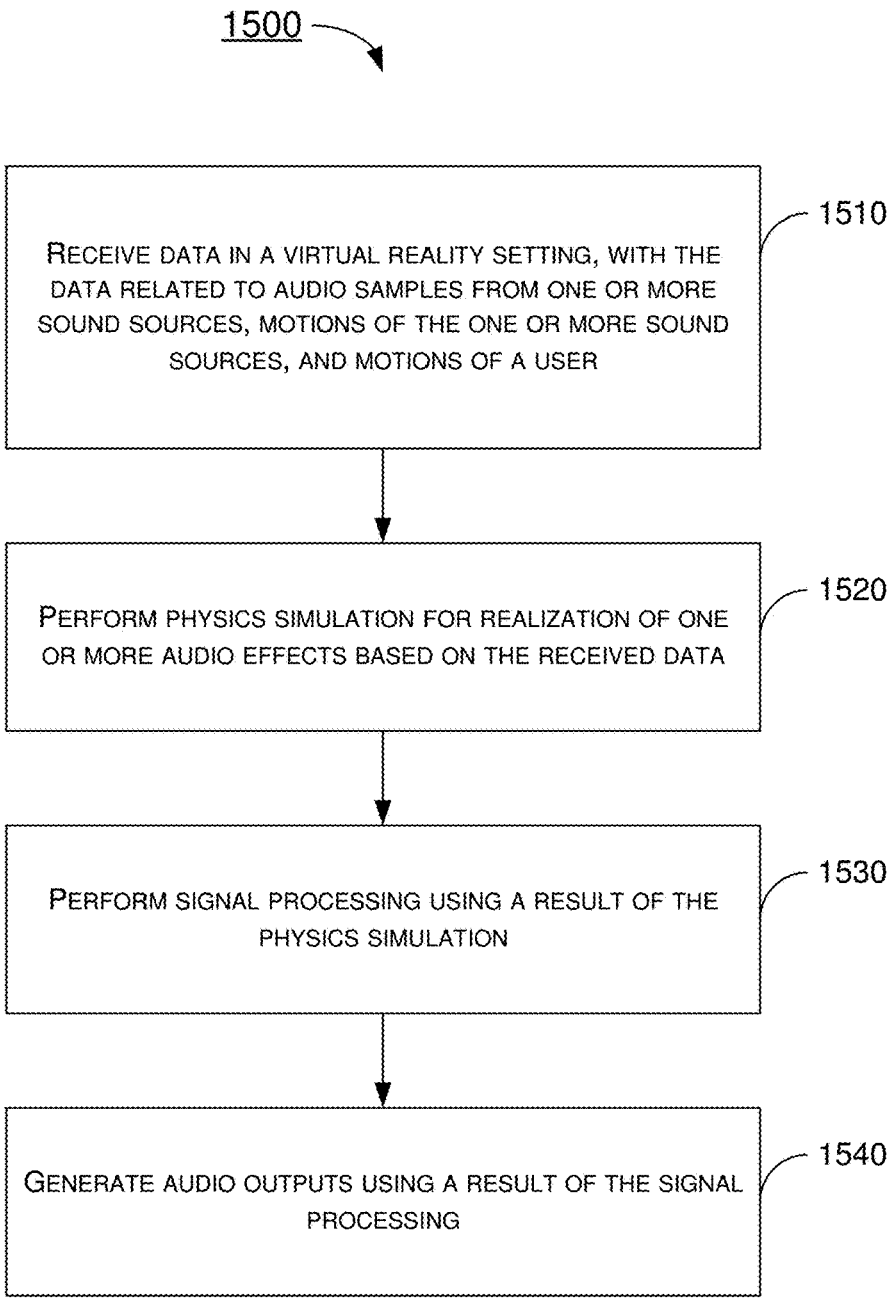
FIG. 15 is a flowchart of an example process in accordance with an implementation of the present disclosure.

FIG. 15 illustrates an example process 1500 in accordance with an implementation of the present disclosure. Process 1500 may be an example implementation of concept 100, scheme 500 as well as any of scenarios 200, 300, 400, 600, 700, 800, 900, 1000, 1100 and 1200, whether partially or completely, with respect to enhanced audio effect realization for virtual reality in accordance with the present disclosure. Process 1500 may represent an aspect of implementation of features of apparatus 1300 and apparatus 1400. Process 1500 may include one or more operations, actions, or functions as illustrated by one or more of blocks 1510, 1520, 1530 and 1540. Although illustrated as discrete blocks, various blocks of process 1500 may be divided into additional blocks, combined into fewer blocks, or eliminated, depending on the desired implementation. Moreover, the blocks of process 1500 may executed in the order shown in FIG. 15 or, alternatively, in a different order. Process 1500 may be implemented by apparatus 1300 and/or apparatus 1400. Solely for illustrative purposes and without limitation, process 1500 is described below in the context of apparatus 1400. Process 1500 may begin at either block 1510 or block 1520.

At 1510, process 1500 may involve processor 1410 of apparatus 1400 receiving data in a virtual reality setting (e.g., from sensor hub 1430). The data may be related to audio samples from one or more sound sources, motions of the one or more sound sources, and motions of a user. Process 1500 may proceed from 1510 to 1520.

At 1520, process 1500 may involve processor 1410 performing physics simulation for realization of one or more audio effects based on the received data. Process 1500 may proceed from 1520 to 1530.

At 1530, process 1500 may involve processor 1410 performing signal processing using a result of the physics simulation. Process 1500 may proceed from 1530 to 1540.

At 1540, process 1500 may involve processor 1410 generating audio outputs using a result of the signal processing (e.g., audio component 1420 outputting output samples received from processor 1410).

In some implementations, in performing the physics simulation for the realization of the one or more audio effects, process 1500 may involve processor 1410 performing a number of operations. For instance, process 1500 may involve processor 1410 generating sample wavefronts for the audio samples, spreading the sample wavefronts, and determining a type of frequency shift and a degree of shift for each of the audio samples based on a respective one of the sample wavefronts observed near the user in the virtual reality setting. In some implementations, in performing the physics simulation for the realization of the one or more audio effects, process 1500 may additionally involve processor 1410 simulating a transmission time of sound with respect to the audio samples from the one or more sound sources.

In some implementations, in performing the signal processing, process 1500 may involve processor 1410 performing a number of operations. For instance, for each sound source of the one or more sound sources, process 1500 may involve processor 1410 resampling each of the audio sample according to the respective type of frequency shift and the respective degree of shift to provide resampled audio samples. Moreover, for each sound source of the one or more sound sources, process 1500 may involve processor 1410 performing sample rendering on the resampled audio samples by filtering for the one or more audio effects to provide final samples. In addition, process 1500 may involve processor 1410 mixing the final samples from the one or more sound sources to generate the audio outputs.

In some implementations, each of the sample wavefronts may represent a respective set of samples of the audio samples. In such cases, in resampling each of the audio samples, process 1500 may involve processor 1410 resampling a plurality sets of samples of the audio samples.

In some implementations, in performing the physics simulation for the realization of the one or more audio effects, process 1500 may involve processor 1410 simulating physics pertaining to a Doppler effect experienced by the user in the virtual reality setting to obtain information on a type of frequency shift and a degree of shift for each of the audio samples. Moreover, in performing the signal processing, process 1500 may involve processor 1410 revising the audio samples by resampling the audio samples depending on the respective type of frequency shift and the respective degree of shift for each of the audio samples.

In some implementations, the type of frequency shift may include an upshift or a downshift. The upshift may be due to a decreasing distance between the user and at least one of the one or more sound sources in the virtual reality setting. The downshift may be due to an increasing distance between the user and the at least one of the one or more sound sources in the virtual reality setting.

In some implementations, in performing the physics simulation for the realization of the one or more audio effects, process 1500 may involve processor 1410 simulating changes of one or more behaviors of the one or more sound sources and one or more behaviors of the user over time along a time axis.

In some implementations, in simulating the changes of the one or more behaviors of the one or more sound sources and the one or more behaviors of the user over time along the time axis, process 1500 may involve processor 1410 performing a number of operations. For instance, process 1500 may involve processor 1410 executing a plurality of tasks to realize a Doppler effect experienced by the user in the virtual reality setting. The plurality of tasks may include: generating sample wavefronts for the audio samples; spreading the sample wavefronts; determining a type of frequency shift and a degree of shift for each of the audio samples based on a respective one of the sample wavefronts observed near the user in the virtual reality setting; resampling, for each sound source of the one or more sound sources, each of the audio sample according to the respective type of frequency shift and the respective degree of shift to provide resampled audio samples; performing, for each sound source of the one or more sound sources, sample rendering on the resampled audio samples by filtering for the one or more audio effects to provide final samples; and mixing the final samples from the one or more sound sources to generate the audio outputs. A scheduler and a timer may be utilized such that the scheduler may be utilized to determine, based on time information from the timer, timing for execution of each of the tasks and triggers the execution.

In some implementations, in executing the plurality of tasks to realize the Doppler effect experienced by the user in the virtual reality setting, process 1500 may involve processor 1410 dividing a process for each of the tasks into a respective plurality of sub-processes such that each sub-process corresponds to a respective time segment of a plurality of time segments along the time axis. Additionally, process 1500 may involve processor 1410 adjusting each of the sub-processes according to motions of the one or more sound sources and motions of the user during the corresponding time segment.

In some implementations, in simulating the changes of the one or more behaviors of the one or more sound sources and the one or more behaviors of the user over time along the time axis, process 1500 may involve processor 1410 executing a plurality of tasks to realize a Doppler effect experienced by the user in the virtual reality setting. For instance, process 1500 may involve processor 1410 dividing a process for each of the tasks into a respective plurality of sub-processes such that each sub-process corresponds to a respective time segment of a plurality of time segments along the time axis. During each time segment, process 1500 may involve processor 1410 performing a number of operations, including: executing the corresponding sub-process; determining whether a next sub-process for one or more target time segments later in time along the time axis is to be generated; generating the next sub-process responsive to a positive result of the determining; inserting the next sub-process into the one or more target time segments; and executing the next sub-process upon arrival of the one or more target time segments. In some implementations, during each time segment, process 1500 may involve processor 1410 performing additional operations, including: updating a motion of the user based on the data related to the motions of the user for the time segment; and updating a respective motion of each of the one or more sound sources based on the data related to the motions of the one or more sound sources for the time segment. In some implementations, the updating of the motion of the user and the updating of the respective motion of each of the one or more sound sources may be performed in parallel.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A method, comprising:

receiving, by a simulation circuit of a processor of an apparatus, data in a virtual reality setting, the data related to audio samples from one or more sound sources, motions of the one or more sound sources, and motions of a user;

performing, by the simulation circuit of the processor, physics simulation for realization of one or more audio effects based on the received data;

performing, by a signal processing circuit of the processor, signal processing using a result of the physics simulation; and generating, by the signal processing circuit of the processor, audio outputs using a result of the signal processing, wherein the performing of the physics simulation for the realization of the one or more audio effects comprises performing the physics simulation sample by sample using the data related to the audio samples by performing, for each of the audio samples, operations comprising:

generating a respective sample wavefront for a respective audio sample of the audio samples;

spreading the respective sample wavefront; and determining a type of frequency shift and a degree of shift for the respective audio sample based on the respective sample wavefront observed near the user in the virtual reality setting.

2. The method of claim 1, wherein the performing of the physics simulation for the realization of the one or more audio effects further comprises:

simulating a transmission time of sound with respect to the audio samples from the one or more sound sources.

3. The method of claim 1, wherein the performing of the signal processing comprises:

for each sound source of the one or more sound sources, performing operations comprising:

resampling each of the audio sample according to the respective type of frequency shift and the respective degree of shift to provide resampled audio samples; and performing sample rendering on the resampled audio samples by filtering for the one or more audio effects to provide final samples; and mixing the final samples from the one or more sound sources to generate the audio outputs.

4. The method of claim 3, wherein each of the sample wavefronts represents a respective set of samples of the audio samples, and wherein the resampling of each of the audio samples comprises resampling a plurality sets of samples of the audio samples.

5. The method of claim 1, wherein:

the performing of the physics simulation for the realization of the one or more audio effects comprises simulating physics pertaining to a Doppler effect experienced by the user in the virtual reality setting to obtain information on the type of frequency shift and the degree of shift for each of the audio samples, and the performing of the signal processing comprises revising the audio samples by resampling the audio samples depending on the respective type of frequency shift and the respective degree of shift for each of the audio samples.

6. The method of claim 5, wherein the type of frequency shift comprises an upshift or a downshift, wherein the upshift is due to a decreasing distance between the user and at least one of the one or more sound sources in the virtual reality setting, and wherein the downshift is due to an increasing distance between the user and the at least one of the one or more sound sources in the virtual reality setting.

7. The method of claim 1, wherein the performing of the physics simulation for the realization of the one or more audio effects comprises simulating, by the simulation circuit of the processor, changes of one or more behaviors of the one or more sound sources and one or more behaviors of the user over time along a time axis.

8. The method of claim 7, wherein the simulating of the changes of the one or more behaviors of the one or more sound sources and the one or more behaviors of the user over time along the time axis comprises:

executing a plurality of tasks to realize a Doppler effect experienced by the user in the virtual reality setting, the plurality of tasks comprising:

for each sound source of the one or more sound sources, performing operations comprising:

resampling each of the audio sample according to the respective type of frequency shift and the respective degree of shift to provide resampled audio samples; and performing sample rendering on the resampled audio samples by filtering for the one or more audio effects to provide final samples; and mixing the final samples from the one or more sound sources to generate the audio outputs, wherein a scheduler determines, based on time information from a timer, timing for execution of each of the tasks and triggers the execution.

9. The method of claim 8, wherein the executing of the plurality of tasks to realize the Doppler effect experienced by the user in the virtual reality setting comprises:

dividing a process for each of the tasks into a respective plurality of sub-processes such that each sub-process corresponds to a respective time segment of a plurality of time segments along the time axis; and adjusting each of the sub-processes according to motions of the one or more sound sources and motions of the user during the corresponding time segment.

10. The method of claim 7, wherein the simulating of the changes of the one or more behaviors of the one or more sound sources and the one or more behaviors of the user over time along the time axis comprises:

executing a plurality of tasks to realize a Doppler effect experienced by the user in the virtual reality setting by performing operations comprising:

dividing a process for each of the tasks into a respective plurality of sub-processes such that each sub-process corresponds to a respective time segment of a plurality of time segments along the time axis; and during each time segment, performing operations comprising:

executing the corresponding sub-process;

determining whether a next sub-process for one or more target time segments later in time along the time axis is to be generated;

generating the next sub-process responsive to a positive result of the determining;

inserting the next sub-process into the one or more target time segments; and executing the next sub-process upon arrival of the one or more target time segments.

11. The method of claim 10, further comprising:

during each time segment, performing operations comprising:

updating a motion of the user based on the data related to the motions of the user for the time segment; and updating a respective motion of each of the one or more sound sources based on the data related to the motions of the one or more sound sources for the time segment, wherein the updating of the motion of the user and the updating of the respective motion of each of the one or more sound sources are performed in parallel.

12. An apparatus, comprising:

a processor comprising:

a simulation circuit capable of performing operations comprising:

receiving data in a virtual reality setting, the data related to audio samples from one or more sound sources, motions of the one or more sound sources, and motions of a user; and performing physics simulation for realization of one or more audio effects based on the received data; and a signal processing circuit coupled to the simulation circuit, the signal processing circuit capable of performing operations comprising:

performing signal processing using a result of the physics simulation; and generating audio outputs using a result of the signal processing, wherein, in performing the physics simulation for the realization of the one or more audio effects, the simulation circuit performs the physics simulation sample by sample and time tick by time tick along a time axis using the data related to the audio samples by performing, for each of the audio samples, operations comprising:

generating a respective sample wavefront for a respective audio sample of the audio samples;

spreading the respective sample wavefront; and determining a type of frequency shift and a degree of shift for the respective audio sample based on the respective sample wavefront observed near the user in the virtual reality setting.

13. The apparatus of claim 12, wherein, in performing the physics simulation for the realization of the one or more audio effects, the simulation circuit is capable of further performing operations comprising:

simulating a transmission time of sound with respect to the audio samples from the one or more sound sources.

14. The apparatus of claim 12, wherein, in performing the signal processing, the signal processing circuit is capable of performing operations comprising:

for each sound source of the one or more sound sources, performing operations comprising:

resampling each of the audio sample according to the respective type of frequency shift and the respective degree of shift to provide resampled audio samples; and performing sample rendering on the resampled audio samples by filtering for the one or more audio effects to provide final samples; and mixing the final samples from the one or more sound sources to generate the audio outputs.

15. The apparatus of claim 14, wherein each of the sample wavefronts represents a respective set of samples of the audio samples, and wherein, in resampling each of the audio samples, the signal processing circuit is capable of resampling a plurality sets of samples of the audio samples.

16. The apparatus of claim 12, wherein:

in performing the physics simulation for the realization of the one or more audio effects, the simulation circuit is capable of simulating physics pertaining to a Doppler effect experienced by the user in the virtual reality setting to obtain information on the type of frequency shift and the degree of shift for each of the audio samples, and in performing the signal processing, the signal processing circuit is capable of revising the audio samples by resampling the audio samples depending on the respective type of frequency shift and the respective degree of shift for each of the audio samples.

17. The apparatus of claim 12, wherein, in performing the physics simulation for the realization of the one or more audio effects, the simulation circuit is capable of simulating changes of one or more behaviors of the one or more sound sources and one or more behaviors of the user over time along the time axis.

18. The apparatus of claim 17, wherein, in simulating the changes of the one or more behaviors of the one or more sound sources and the one or more behaviors of the user over time along the time axis, the simulation circuit is capable of performing operations comprising:

executing a plurality of tasks to realize a Doppler effect experienced by the user in the virtual reality setting;

wherein, in simulating the changes of the one or more behaviors of the one or more sound sources and the one or more behaviors of the user over time along the time axis, the signal processing circuit is capable of performing operations comprising:

for each sound source of the one or more sound sources, performing operations comprising:

resampling each of the audio sample according to the respective type of frequency shift and the respective degree of shift to provide resampled audio samples; and performing sample rendering on the resampled audio samples by filtering for the one or more audio effects to provide final samples; and mixing the final samples from the one or more sound sources to generate the audio outputs, wherein a scheduler determines, based on time information from a timer, timing for execution of each of the tasks and triggers the execution.

19. The apparatus of claim 18, wherein, in executing the plurality of tasks to realize the Doppler effect experienced by the user in the virtual reality setting, the simulation circuit is capable of performing operations comprising:

dividing a process for each of the tasks into a respective plurality of sub-processes such that each sub-process corresponds to a respective time segment of a plurality of time segments along the time axis; and adjusting each of the sub-processes according to motions of the one or more sound sources and motions of the user during the corresponding time segment.

20. The apparatus of claim 17, wherein, in simulating the changes of the one or more behaviors of the one or more sound sources and the one or more behaviors of the user over time along the time axis, the simulation circuit is capable of performing operations comprising:

executing a plurality of tasks to realize a Doppler effect experienced by the user in the virtual reality setting by performing operations comprising:

dividing a process for each of the tasks into a respective plurality of sub-processes such that each sub-process corresponds to a respective time segment of a plurality of time segments along the time axis; and during each time segment, performing operations comprising:

executing the corresponding sub-process;

determining whether a next sub-process for one or more target time segments later in time along the time axis is to be generated;

generating the next sub-process responsive to a positive result of the determining;

inserting the next sub-process into the one or more target time segments;

executing the next sub-process upon arrival of the one or more target time segments;

updating a motion of the user based on the data related to the motions of the user for the time segment; and updating a respective motion of each of the one or more sound sources based on the data related to the motions of the one or more sound sources for the time segment, wherein the updating of the motion of the user and the updating of the respective motion of each of the one or more sound sources are performed in parallel.

* * * * *